United States Patent [19]

Lynm et al.

[11] Patent Number: 4,715,389

[45] Date of Patent: Dec. 29, 1987

[54] CIGARETTE

[75] Inventors: Dwo Lynm; Carl C. Morrison, both of Winston-Salem; Ronald W. Hutcherson, Sr., King, all of N.C.

[73] Assignee: R. J. Reynolds Tobacco Company, Winston-Salem, N.C.

[21] Appl. No.: 907,175

[22] Filed: Sep. 15, 1986

[51] Int. Cl.[4] ..... A24D 1/00

[52] U.S. Cl. ..... 131/335; 131/360; 131/344

[58] Field of Search ..... 131/335, 360, 341, 342, 131/344, 331

[56] References Cited

U.S. PATENT DOCUMENTS

| | | | |
|---|---|---|---|
| 2,976,190 | 3/1961 | Meyer | 131/331 |
| 3,584,630 | 6/1971 | Inskeep | 131/335 |
| 3,861,400 | 1/1975 | Perkins et al. | 131/335 |
| 3,902,504 | 9/1975 | Owens, Jr. et al. | 131/360 |
| 4,598,720 | 7/1986 | Gabriel | 131/335 |

*Primary Examiner*—V. Millin
*Assistant Examiner*—H. Macey

[57] ABSTRACT

A cigarette having internal heat sinks of aluminum mesh and a section of carbonized flue-cured tobacco stem material containing adsorbed nicotine produces smoke having lower TPM and higher nicotine than smoke from conventional cigarettes.

9 Claims, 1 Drawing Figure

CIGARETTE

TECHNICAL FIELD

This invention relates to a cigarette provided With internal heat sinks and special nicotine-containing adsorbent resulting in delivery of smoke having a lower ratio of particulate matter to nicotine than is normal from ordinary filtered or unfiltered cigarette.

BACKGROUND ART

The use of filters on cigarettes results in lowering both nicotine and particulate matter in the smoke delivered. Efforts to restore or increase the nicotine delivery by adding nicotine to the smoking material, usually tobacco have not been very successful because some of the nicotine was consumed in the fire cone and some was lost by oxidation. Also, while in storage some nicotine was lost to oxidation even before the pack was opened.

One attempt to overcome these problems is taught in Perkins et al, U.S. Pat. No. 3,861,400, entitled, "Nicotine Fortification of Smoking Products". There, a nicotine derivative of polygalacturonic acid or polymannuronic acid was prepared and added to the smoking material to release small amounts of nicotine upon pyrolysis. These derivatives were said to be stable during storage.

A different approach to reducing particulate matter in the smoke but which also reduces nicotine is taught in Gabriel, U.S. Pat. No. 4,598,720. This patent teaches placing small pellets of crushed aluminum foil along the axis of a tobacco rod to provide a relatively cold surface for condensation of particulate matter ("tar") and nicotine from the smoke.

SUMMARY OF THE INVENTION

The present invention provides an improved cigarette which affords an enhanced delivery of free, unbonded nicotine and a reduced delivery of total particulate matter (TPM) in the smoke. The cigarette comprises a column of smoking material, such as tobacco, wrapped with conventional cigarette paper and having a plurality of segments of aluminum screen material axially aligned within the column of tobacco and a section of carbonized flue-cured tobacco stem material impregnated with nicotine axially aligned with the segments within the column of tobacco.

DETAILED DESCRIPTION OF PREFERRED EMBODIMENTS

Figure 1:
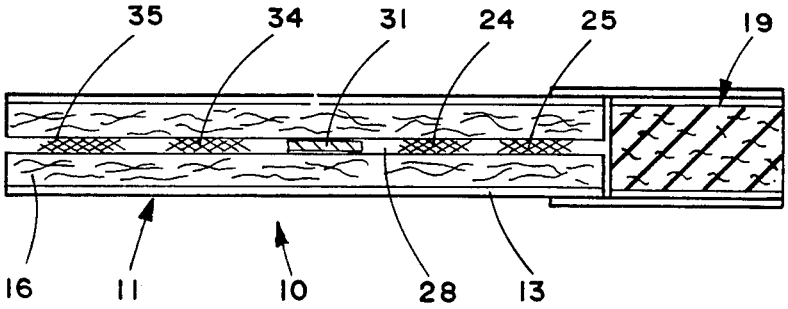
FIG. 1 is a longitudinal sectional view of a filter cigarette of this invention.

A preferred embodiment of the cigarette of the present invention utilizes four segments of aluminum screen material. The segments are made by cutting a strip of 200 mesh aluminum screen about 7 to 9 mm. wide and about 9 to 11 mm. long and rolling the strip into a cylinder about 1.8 to 2.2 mm. in diameter. These screen segments weigh about 9 to 11.5 mg. each.

The carbonized flue-cured tobacco stem material is made by placing flue-cured stems about 2 mm. in diameter into a vessel in an atmosphere of inert gas such as carbon dioxide or nitrogen. A flow of $CO_2$, or nitrogen is maintained through the vessel while the stems are heated to about 300° to 700° C. for a time sufficient to remove all volatile substances from the stems, usually about 0.5 to 3 hours, and convert the hydrocarbon structure of the stems to carbon. The carbonized stem material is cooled under the $CO_2$, or nitrogen to prevent combustion upon opening of the vessel and recovery of the carbonized stem material. Sections about 10 mm. long are cut from the carbonized stem material with a sharp cutting tool such as a razor blade. The stem sections are changed little in diameter during carbonization. A carbonized flue-cured stem section 2 mm. in diameter and 10 mm. long weighs only about 0.5 to 0.7 milligrams, indicating that it is very porous.

Free, unbonded nicotine is impregnated into the carbonized stem sections by depositing it onto each one from a hypodermic. Surprisingly, a carbonized flue-cured tobacco stem section 2 mm. in diameter and 10 mm. long will adsorb about 10 mg. of nicotine. Nicotine in salt form is not used because it will not be completely converted to the desired free form.

The nicotine adsorbed into the carbonized flue-cured tobacco stem material is protected against significant oxidation during storage, yet the nicotine is readily distilled out by heat from the fire cone of the lighted cigarette thus providing delivery of a high proportion of the added nicotine into the mainstream smoke.

Referring to FIG. 1, the cigarette 10 has a tobacco rod 11 including cigarette paper wrap 13 which wraps a column of smokable material 16. The cigarette has a cellulose acetate filter 19 attached to one end of the tobacco rod 11. The cigarette includes a cylindrical segments of aluminum screen 24 and 25 axially aligned within channel 28 which extends through the column. A segment 31 of carbonized flue-cured tobacco stem material impregnated with nicotine is axially aligned with the aforementioned segments of screen. The cigarette also includes segments of aluminum screen 34 and 35 axially aligned within the channel 28 such that the carbonized tobacco stem segment 31 is positioned between segments 24, 25 and segments 34, 35.

For example, cigarettes of the present invention were made by punching an axial channel about 2 mm. in diameter in conventional cigarettes and placing into the channel first two aluminum mesh segments 8 mm. long and 2 mm. diameter, then one nicotine impregnated carbonized flue-cured tobacco stem section containing 10 mg. of nicotine, and then two more aluminum mesh segments. This resulted in the carbonized stem section being located at about the middle of the length of the tobacco rod. It is preferred that filter cigarettes be used and that the carbonized stem section be located about one-half to two-thirds of the length of the tobacco rod away from the filter end of the rod. Cigarettes having five aluminum segments are also satisfactory.

Test cigarettes prepared in this manner and containing four aluminum screen segments and one carbonized stem section containing 10 mg. of nicotine were smoked on a standard FTC smoking machine. The following results were obtained from smoking of 5 filter (cellulose acetate) cigarettes per run in triplicate:

| | MILLIGRAMS PER CIGARETTE | |
|---|---|---|
| | CONTROL | TEST CIGS. |
| Water | 2.25 | 1.28 |
| Nicotine | 1.15 | 1.55 |
| TPM | 15.03 | 8.21 |
| T/N RATIO | 13.07 | 5.30 |

As is readily seen from these data, the test cigarettes of the present invention deliver lower TPM and higher nicotine than the conventional cigarettes which results in the desired lower TPM to nicotine (T/N) ratio.

Having thus described the invention, what is claimed is:

1. An improved cigarette affording an enhanced delivery of nicotine and a reduced delivery of particulate matter in the smoke which comprises a column of cigarette tobacco wrapped with cigarette paper, a plurality of segments of aluminum screen material axially aligned within the column of tobacco and a section of carbonized flue-cured tobacco stem material impregnated with nicotine axially aligned with said segments within said column of tobacco.

2. The cigarette of claim 1 wherein said plurality is four.

3. The cigarette of claim 2 wherein each of said segments is in the shape of a cylinder about 8 mm. long and about 2 mm. in diameter.

4. The cigarette of claim 1 wherein said section of carbonized flue-cured tobacco stem material is located at about the middle of the axial length of the cigarette.

5. The cigarette of claim 1 wherein said section of carbonized flue-cured tobacco stem material is about 10 mm. long and about 2 mm. in diameter.

6. The cigarette of claim 1 wherein said section of carbonized flue-cured tobacco stem material is impregnated with about 10 milligrams of nicotine.

7. The cigarette of claim 1 wherein said cigarette is a filter cigarette having a filter attached to one end of said column and said section of carbonized flue-cured stem material is located about two-thirds of the length of the column of cigarette tobacco away from the filter.

8. A filter cigarette which produces smoke having a lower ratio of TPM to nicotine than conventional filter cigarettes, which comprises a tobacco rod wrapped with cigarette paper and having a cellulose acetate tow filter attached to one end, said tobacco rod containing in axial alignment within the tobacco two aluminum mesh segments, one section of carbonized flue-cured tobacco stem material having about 10 mg. of nicotine adsorbed therein and two more aluminum mesh segments, respectively, each of said aluminum mesh segments being about 2 mm. in diameter and about 8 mm. in length.

9. The cigarette of claim 8 wherein said section is located betwen one-half and two-thirds of the length of the tobacco rod from the filter end of the rod.

* * * * *